US005579747A

United States Patent [19]

Sato et al.

[11] Patent Number: 5,579,747

[45] Date of Patent: Dec. 3, 1996

[54] DEVICE FOR DETECTING ABNORMALITY OF FUEL SUPPLY SYSTEM OF INTERNAL COMBUSTION ENGINES

[75] Inventors: Ryuji Sato; Kojiro Tsutsumi; Hisashi Igarashi; Sachito Fujimoto, all of Wako, Japan

[73] Assignee: Honda Giken Kogyo Kabushiki Kaisha, Tokyo, Japan

[21] Appl. No.: 550,098

[22] Filed: Oct. 30, 1995

[30] Foreign Application Priority Data

Oct. 31, 1994 [JP] Japan ..... 6-290703

[51] Int. Cl.[6] ..... F02D 41/22; F02M 25/08

[52] U.S. Cl. ..... 123/690; 123/698

[58] Field of Search ..... 123/479, 520, 123/690, 698

[56] References Cited

U.S. PATENT DOCUMENTS 5,070,847 12/1991 Akiyama et al. ..... 123/690 X 5,462,034 10/1995 Kadota ..... 123/690 X

FOREIGN PATENT DOCUMENTS 6-42382 2/1994 Japan .

*Primary Examiner*—Tony M. Argenbright

*Attorney, Agent, or Firm*—Nikaido, Marmelstein, Murray & Oram LLP

[57] ABSTRACT

A device for detecting abnormality of the fuel supply system of an internal combustion engine inhibits supply of evaporative fuel to the intake passage when the air-fuel ratio correction coefficient becomes smaller than a predetermined value, and thereafter determines that the fuel supply system is normal when the air-fuel ratio correction coefficient increases above the predetermined value as a result of the inhibition of the supply of the evaporative fuel. The supply of the evaporative fuel to the intake passage is resumed after the determination that the fuel supply system is normal has been made. Determination of abnormality of the fuel supply system is inhibited after resuming of the supply of the evaporative fuel until the engine enters a predetermined operating condition in which the air-fuel ratio correction coefficient has increased. The determination of abnormality of the fuel supply system is permitted to be resumed, based on the air-fuel ratio correction coefficient when the engine has entered the predetermined operating condition.

4 Claims, 6 Drawing Sheets

THREE-WAY CATALYST
15
17
18L
18R
O2
O2
16L
16R
14
13
12
11
10
9
INTERNAL COMBUSTION ENGINE
1
CYL
NE
TW
TA
PBA
FUEL INJECTION VALVE
6
7
22
21
20
8
2
3'
3
θ TH
4
5
5a
5b
5c
5d
INPUT CIRCUIT
C P U
MEMORY MEANS
OUTPUT CIRCUIT
E C U
23
19

DEVICE FOR DETECTING ABNORMALITY OF FUEL SUPPLY SYSTEM OF INTERNAL COMBUSTION ENGINES

BACKGROUND OF THE INVENTION

1. Field of the Invention

This invention relates to a device for detecting abnormality of the fuel supply system of internal combustion engines, and more particularly to a device of this kind which detects abnormality of the fuel supply system by the use of an air-fuel ratio correction coefficient set in response to an output from an exhaust gas component concentration sensor arranged in the exhaust system of the engine.

2. Prior Art

Conventionally, there has been proposed, e.g. by the present assignee in Japanese Laid-Open Patent Publication (Kokai) No. 6-42382, a technique of detecting abnormality of the fuel supply system of an internal combustion engine, such as deviation of the fuel supply amount from a controllable range due to clogging of a fuel injection valve, biting of foreign matter, aging of the system, etc. According to this technique, an air-fuel ratio correction coefficient is calculated based on an output from an exhaust gas component concentration sensor arranged in the exhaust system of the engine, and it is determined that the fuel supply system is abnormal when an average value of the air-fuel ratio correction coefficient deviates from a predetermined range.

The present assignee has also proposed another technique of detecting abnormality of the fuel supply system by Japanese Patent-Application No. 6-73909. According to this technique, when an average value of the air-fuel ratio correction coefficient deviates from a predetermined range, it is once determined that the fuel supply system is abnormal, similarly to the first-mentioned technique, but if the average value is thereafter changing toward the center of the predetermined range, the calculation of the average value is continued, and when the average value comes to stay within the predetermined range, it is quickly determined that the fuel supply system is normal.

In this abnormality determination, the air-fuel ratio correction coefficient calculated based on the output from the exhaust gas component concentration sensor is readily influenced by purging of evaporative fuel generated from a fuel tank, and when a large amount of evaporative fuel is purged, the air-fuel ratio correction coefficient is controlled to its limit value or a value in the vicinity thereof. As a result, the average value as an abnormality-determining parameter calculated from such extreme values of the air-fuel ratio correction coefficient under the influence of purging of the evaporative fuel is updated toward the limit value as well, which can lead to an erroneous determination of abnormality of the fuel supply system.

To avoid this inconvenience, according to the proposed technique, when the abnormality-determining parameter is updated to a value lower than a predetermined value, the purging of evaporative fuel is once forced to stop and then the fuel supply system is again checked for a fault. If the value of the abnormality-determining parameter increases during the checking to reveal that the above updating of the parameter is due to purging of evaporative fuel, the checking of the system for a fault is inhibited all the time during the present operation of the engine is stopped, so as to prevent degradation of exhaust emission characteristics and driveability of the engine, which would otherwise result from repeated execution/inhibition of purging of evaporative fuel.

However, according to the prior art technique, execution of the checking of the system for a fault is inhibited during the present operation of the engine as mentioned above, which raises a new problem of incapability of detecting an actual fault of the fuel supply system occurring during inhibition of the checking of the system for a fault. Therefore, there has been an urgent demand for a technique or device which eliminates this inconvenience.

SUMMARY OF THE INVENTION

It is an object of the invention to provide a device for detecting abnormality of the fuel supply system of an internal combustion engine, which is capable of carrying out detection of abnormality of the fuel supply system actually occurring after it was once determined that purging of evaporative fuel caused a determination of abnormality of the system, without degrading exhaust emission characteristics and driveability of the engine.

To attain the above object, the present invention provides a device for detecting abnormality of a fuel supply system of an internal combustion engine having an intake passage, an exhaust passage, at least one exhaust gas component concentration sensor arranged in the exhaust passage for detecting concentration of a component of exhaust gases, air-fuel ratio correction coefficient-calculating means for calculating an air-fuel ratio correction coefficient for correcting an amount of fuel to be supplied to the engine in response to an output from the at least one exhaust gas component concentration sensor such that an air-fuel ratio of a mixture supplied to the engine becomes equal to a predetermined value, a fuel tank, and purge control means for controlling supply of evaporative fuel generated within the fuel tank to the intake passage, the device having abnormality-determining means which inhibits the supply of the evaporative fuel to the intake passage when the air-fuel ratio correction coefficient becomes smaller than a predetermined value, the abnormality-determining means thereafter determining that the fuel supply system is normal when the air-fuel ratio correction coefficient increases above the predetermined value as a result of the inhibition of the supply of the evaporative fuel.

The device according to the invention is characterized by an improvement wherein the abnormality-determining means comprises:

- evaporative fuel supply-resuming means for permitting the supply of the evaporative fuel to the intake passage to be resumed after the determination that the fuel supply system is normal has been made;
- determination-inhibiting means for inhibiting determination of abnormality of the fuel supply system after the supply of the evaporative fuel is restarted until the engine enters a predetermined operating condition in which the air-fuel ratio correction coefficient has increased; and
- determination-resuming means for permitting the determination of abnormality of the fuel supply system to be resumed, based on the air-fuel ratio correction coefficient when the engine has entered the predetermined operating condition.

Preferably, the predetermined operating condition of the engine is a condition in which a predetermined time period has elapsed after the determination that the fuel supply system is normal was made and at the same time the air-fuel ratio correction coefficient increases above a second predetermined value higher than the predetermined value.

Also preferably, the air-fuel ratio correction coefficient used in the determination of the abnormality of the engine is an average value of the air-fuel ratio correction coefficient.

Preferably, the abnormality-determining means determines that the fuel supply system is abnormal without inhibiting the supply of the evaporative fuel to the intake passage, when the air-fuel ratio correction coefficient is lower than a predetermined limit value lower than the predetermined value.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
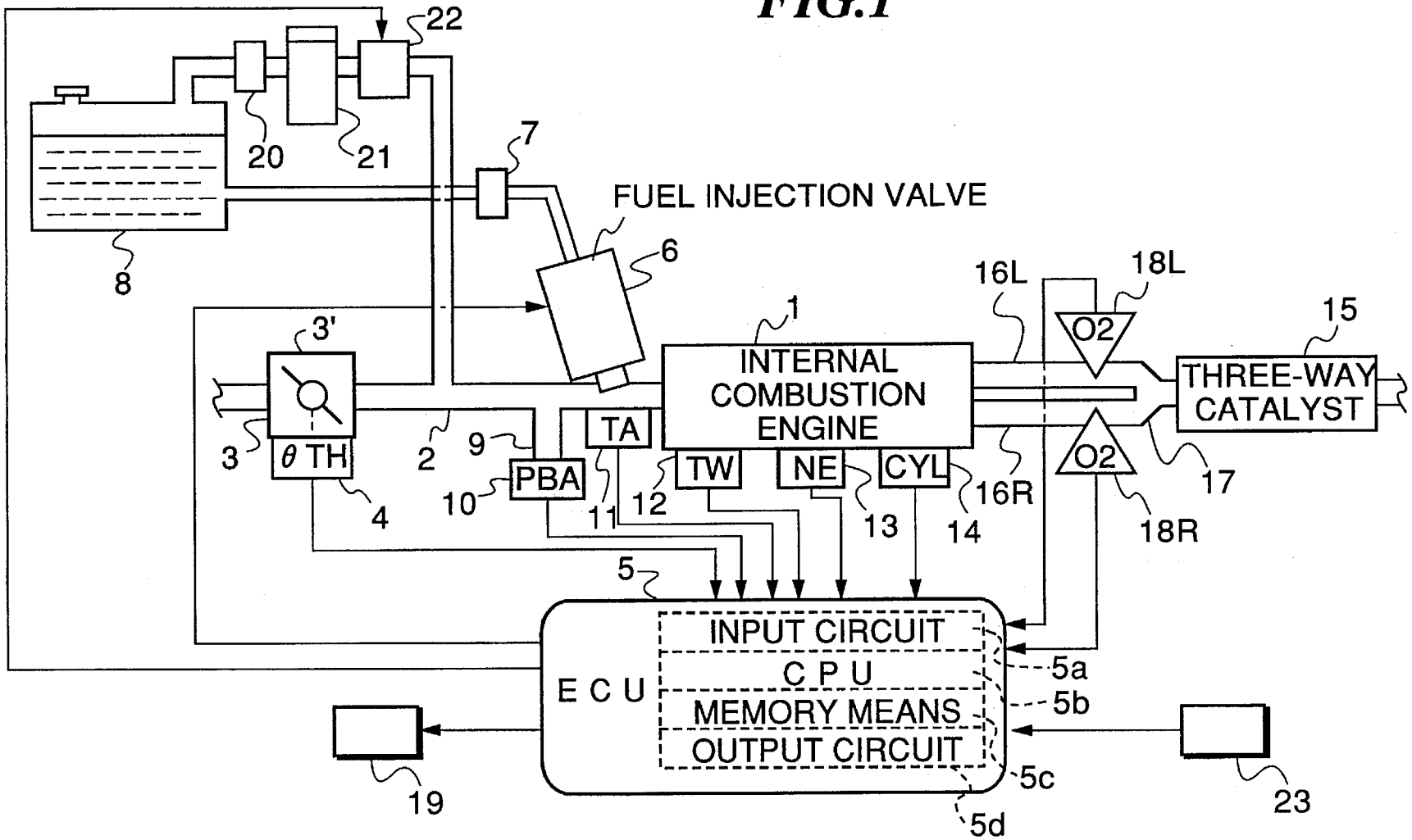
FIG. 1 is a block diagram schematically showing the whole arrangement of a fuel supply control system incorporating a device for detecting abnormality of the fuel supply system of an internal combustion engine, according to an embodiment of the invention.

Referring first to FIG. 1, there is shown the whole arrangement of a fuel supply control system incorporating a device for detecting abnormality of the fuel supply system of an internal combustion engine, according to the embodiment of the invention. In the figure, reference numeral 1 designates a four-cycle internal combustion engine having a total of six cylinders arranged in two separate right and left banks each formed of three cylinders. Connected to the cylinder block of the engine 1 is an intake pipe 2 in which is arranged a throttle body 3 accommodating a throttle valve 3' therein. A throttle valve opening (θTH) sensor 4 is connected to the throttle valve 3' for generating an electric signal indicative of the sensed throttle valve opening θTH and supplying the same to an electric control unit (hereinafter referred to as "the ECU") 5.

Fuel injection valves 6, only one of which is shown, are inserted into the intake pipe 2 at respective locations intermediate between the cylinder block of the engine 1 and the throttle valve 3' and slightly upstream of respective intake valves, not shown. The fuel injection valves 6 are connected via a fuel pump 7 to a fuel tank 8, and electrically connected to the ECU 5 to have their valve opening periods controlled by signals therefrom.

Further, an intake pipe absolute pressure (PBA) sensor 10 is provided in communication with the interior of the intake pipe 2 via a conduit 9 opening into the intake pipe 2 at a location between the throttle valve 3' and the fuel injection valves 6 for supplying an electric signal indicative of the sensed absolute pressure PBA within the intake pipe 2 to the ECU 5.

An intake air temperature (TA) sensor 11 is inserted into the intake pipe 2 at a location downstream of the PBA sensor 10, for supplying an electric signal indicative of the sensed intake air temperature TA to the ECU 5.

An engine coolant temperature (TW) sensor 12 formed of a thermistor or the like is inserted into a coolant passage, not shown, filled with a coolant and formed in the cylinder block, for supplying an electric signal indicative of the sensed engine coolant temperature TW to the ECU 5.

An engine rotational speed (NE) sensor 13 and a cylinder-discriminating (CYL) sensor 14 are arranged in facing relation to a camshaft or a crankshaft, neither of which is shown, of the engine at respective predetermined locations. The engine rotational speed sensor 13 generates a pulse (hereinafter referred to as "TDC signal pulse(s)" at a predetermined crank angle position whenever the crankshaft rotates through 120 degrees, while the cylinder-discriminating sensor 14 generates a pulse (hereinafter referred to as "CYL signal pulse(s)" at a predetermined crank angle of a particular cylinder of the engine. These signal pulses are supplied to the ECU 5.

A three-way catalyst 15 is arranged in a confluent portion of an exhaust pipe 17 to which are connected exhaust pipes 16L, 16R extending respectively from the left and right banks of cylinders, for purifying noxious components HC, CO, NOx, etc. contained in exhaust gases. 02 sensors 18L, 18R as exhaust gas component concentration sensors are arranged in the exhaust pipes 16L, 16R, for separately detecting respective concentrations of oxygen contained in exhaust gases flowing through the exhaust pipes 16L, 16R, and supplying signals indicative of the sensed oxygen concentration detected in the respective exhaust pipes 16L, 16R to the ECU 5.

Also connected to the ECU is a vehicle speed (V) sensor 23 for detecting the vehicle speed V of an automotive vehicle in which is installed the engine 1, and supplying a signal indicative of the sensed vehicle speed to the ECU 5. Further, the ECU 5 has a display device 19 formed of an LED (light emitting diode) connected thereto for displaying a warning indication when abnormality is detected of the fuel supply system of the engine according to a program routine described in detail hereinafter with reference to FIG. 2.

Arranged between the fuel tank 8 and a portion of the intake pipe 2 immediately downstream of the throttle valve 3 is an evaporative emission control system which is comprised of a two-way valve 20, a canister 21, and a purge control valve 22. The purge control valve 22 is connected to the ECU 5 to have its operation controlled by a control signal therefrom. More specifically, evaporative fuel generated in the fuel tank 8 increases in pressure within the fuel tank 8, and when the pressure within the fuel tank 8 reaches a predetermined value, a positive pressure valve, not shown, of the two-way valve 20 is forced to open by the increased pressure to permit evaporative fuel to flow into the canister 21 for temporary storage therein. When the purge control valve 22 is opened in response to a control signal from the ECU 5, evaporative fuel stored in the canister 21 is drawn into the intake pipe 2 together with fresh air introduced into the canister 21 via an air inlet port, not shown, provided therein by a drawing force of vacuum created within the intake pipe 2, and supplied to the cylinders. When the fuel tank 8 is cooled e.g. by a cold ambient air so that negative pressure increases within the fuel tank 8, a negative pressure valve, not shown, of the two-way valve 20 is opened to return evaporative fuel stored in the canister 21 to the fuel tank 8. The evaporative emission control system thus prevents evaporative fuel generated in the fuel tank 8 from being emitted into the atmosphere.

The ECU 5 is comprised of an input circuit 5*a* having the functions of shaping the waveforms of input signals from various sensors including those mentioned above, shifting voltage levels of sensor input signals to a predetermined level, converting analog signals from analog-output sensors to digital signals, and so forth, a central processing unit (hereinafter referred to as "the CPU") 5*b* for carrying out processings described hereinbelow etc., memory means 5*c* storing various operational programs which are executed by the CPU 5*b*, and for storing results of calculation therefrom, etc., and an output circuit 5*d* which delivers respective driving signals to the fuel injection valves 6, the purge control valve 22, the display device 19, etc.

The CPU 5*b* operates in response to engine operating parameter signals from various sensors including those mentioned above to determine operating conditions in which the engine 1 is operating, such as air-fuel ratio feedback control region where the air-fuel ratio is controlled in response to the detected oxygen concentration in the exhaust gases, and air-fuel ratio open-loop control regions, and calculates, based upon the determined engine operating conditions, a fuel injection period TOUT over which the fuel injection valve 6 is to be opened in synchronism with generation of TDC signal pulses, by the use of the following equation (1):

$$TOUT=Ti\times K02\times K1+K2 \quad (1)$$

where Ti represents a basic value of the fuel injection period TOUT, which is read from a Ti map according to the engine rotational speed NE and the intake pipe absolute pressure PBA.

K02 represents an air-fuel ratio correction coefficient which is set in a feedback manner responsive to the oxygen concentration of exhaust gases detected by the 02 sensors 18L, 18R when the engine is in the air-fuel ratio feedback control region, and to a predetermined value suitable for each of the open loop control regions in which the air-fuel ratio feedback control is inhibited when the engine is in any of the open loop control regions. The correction coefficient KO2 is set for each of the left and right banks of cylinders, separately. For example, a correction coefficient KO2R for the right bank of cylinders is calculated by addition of a proportional term (P term) by proportional control when an output from the 02 sensor 18R for the right bank is inverted in level with respect to a predetermined reference value, and by addition of an integral term (I term) while the output from the same is not inverted. A correction coefficient KO2L for the left bank is calculated in quite the same manner as above, based on an output from the 02 sensor 18L for the left bank.

K1 and K2 represent correction coefficients and correction variables calculated based on various engine operating parameter signals, respectively, and set to respective predetermined values suitable for minimizing the fuel consumption and optimizing accelerability and other operating characteristics of the engine depending on operating conditions thereof.

The CPU 5*b* delivers, via its output circuit 5*d*, the driving signal indicative of the fuel injection period TOUT thus calculated, to each of the fuel injection valves 6 to open the same over the time period TOUT.

Figure 2:
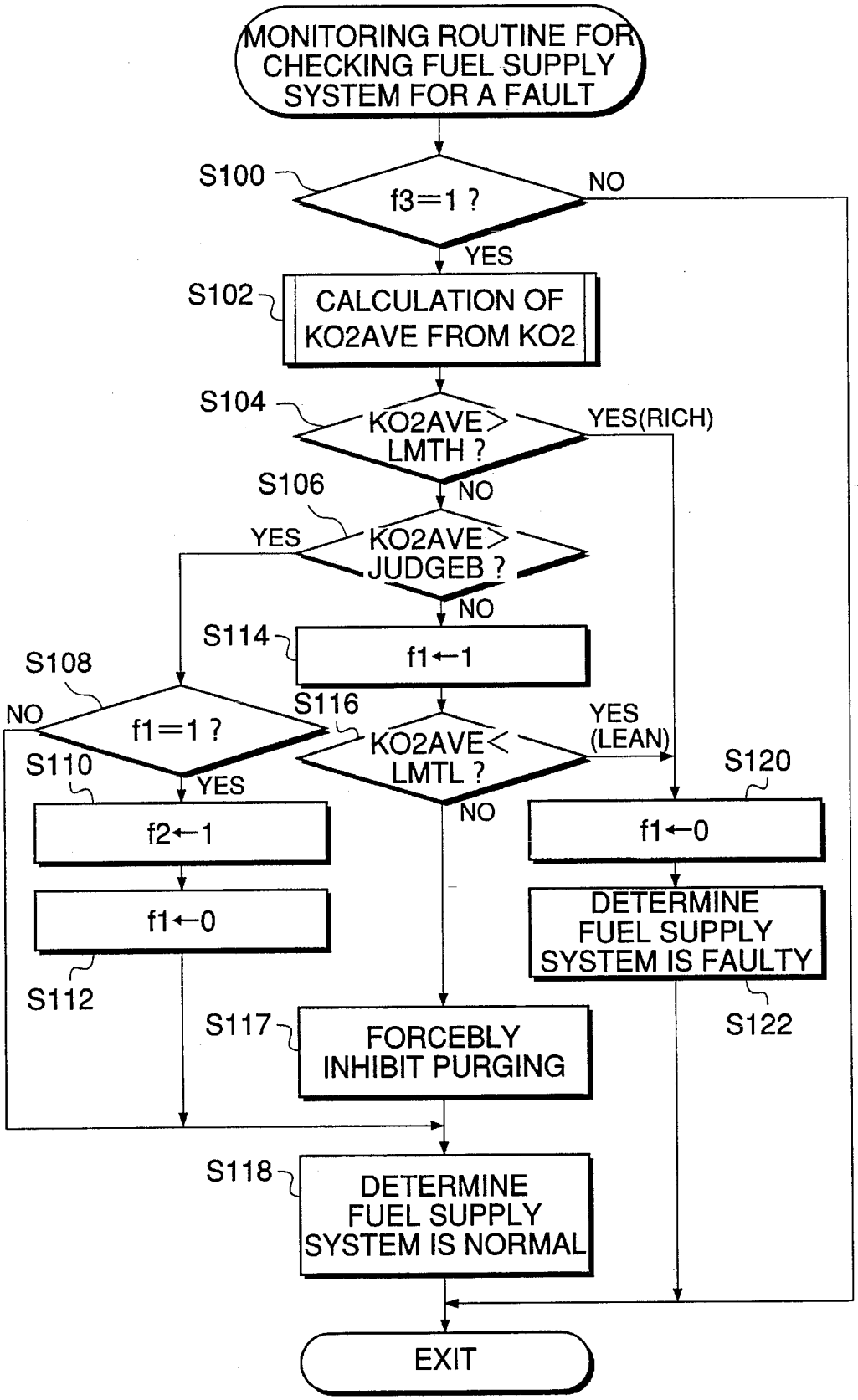
FIG. 2 is a flowchart showing a monitoring routine for checking the fuel supply system for a fault.
Figure 3:
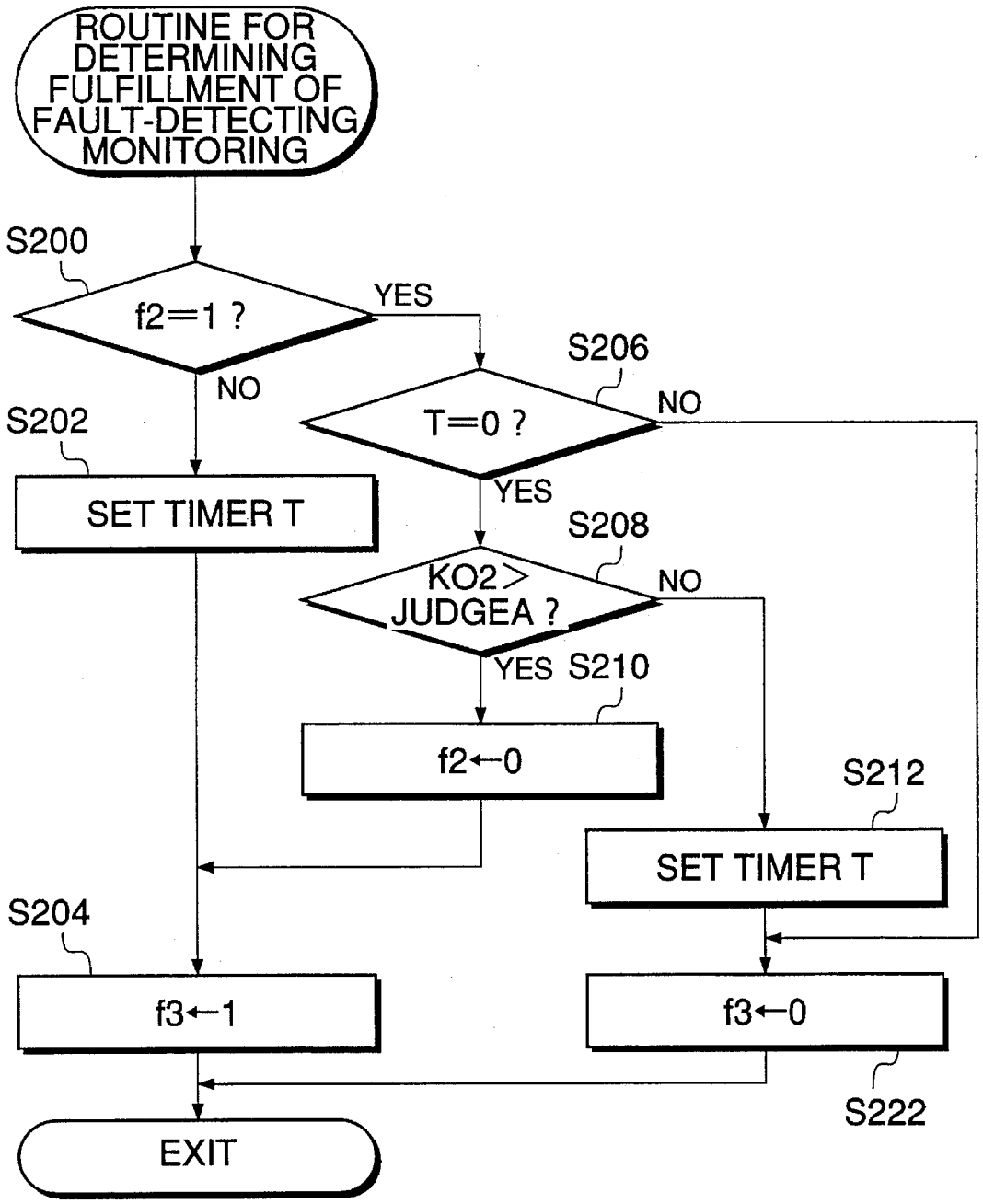
FIG. 3 is a flowchart showing a determining routine for determining whether conditions for executing fault-detecting monitoring are fulfilled.

FIG. 2 shows a monitoring routine for checking the fuel supply system of the engine for a fault, and FIG. 3 a determining routine for determining whether conditions for executing fault-detecting monitoring are fulfilled. The routines are both executed by the CPU 5*b* in synchronism with generation of each TDC signal pulse.

Figures 4A, 4B, 4C, 4D, 4E:
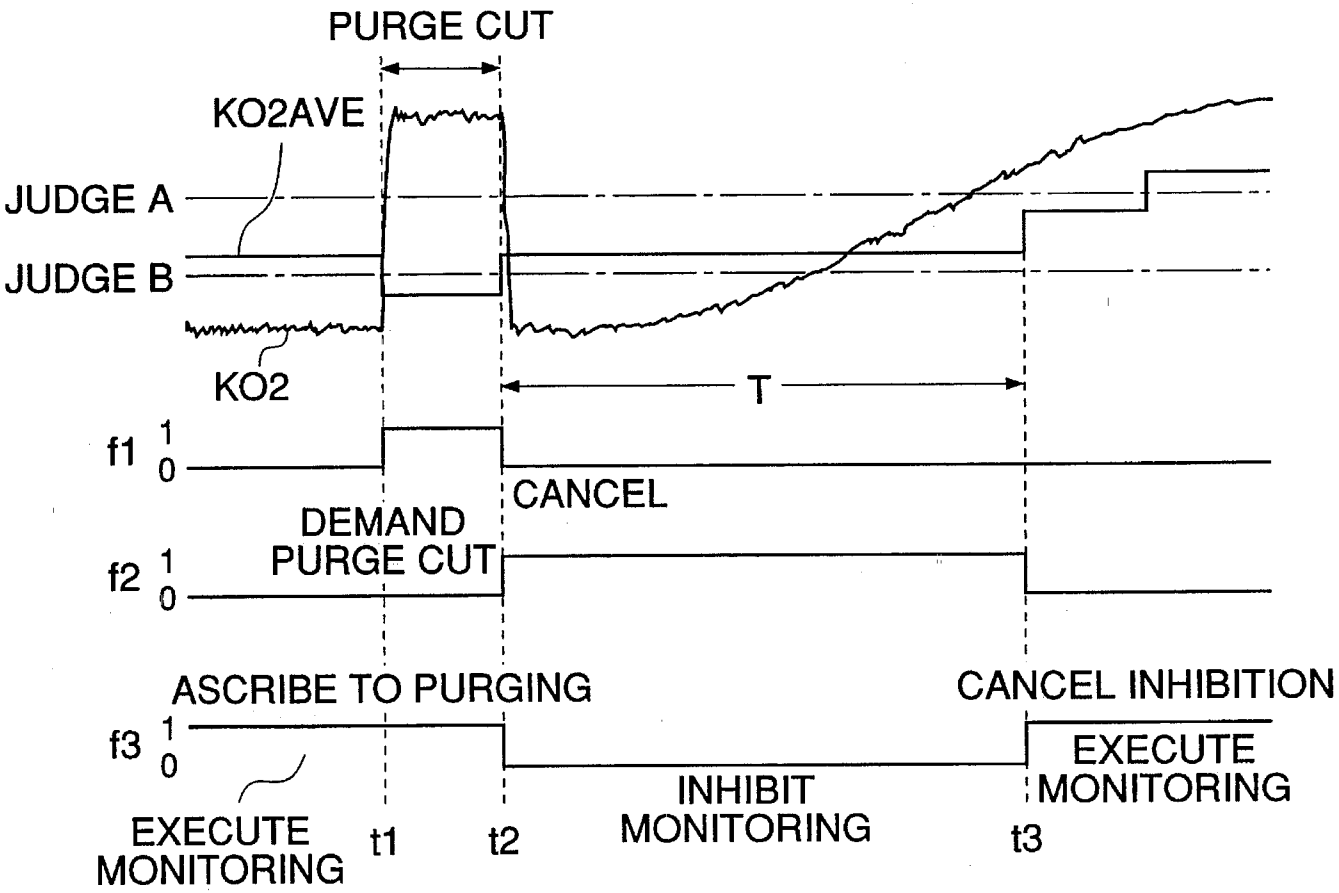
FIGS. 4A–4E are timing charts showing changes in an air-fuel ratio correction coefficient KO2, an abnormality-determining parameter KO2AVE, flags f1, f2, and f3, etc.

The routines shown in FIGS. 2 and 3 will be described below with reference to FIG. 4 which illustrates timing of changes in the air-fuel ratio correction coefficient K02, an abnormality-determining parameter KO2AVE, etc., as time elapses.

In the FIG. 2 monitoring routine, it is first determined at a step S100 whether or not a monitoring execution flag f3 has been set to a value of 1. The monitoring execution flag f3 is set to a value of 1 when fault-detecting monitoring is to be carried out on the fuel supply system, and to a value of 0 when the fault-detecting monitoring is to be inhibited. When the monitoring execution flag f3 assumes the value of 0, it is judged that the fault-detecting monitoring is inhibited, and the present routine is immediately terminated.

Figure 5:
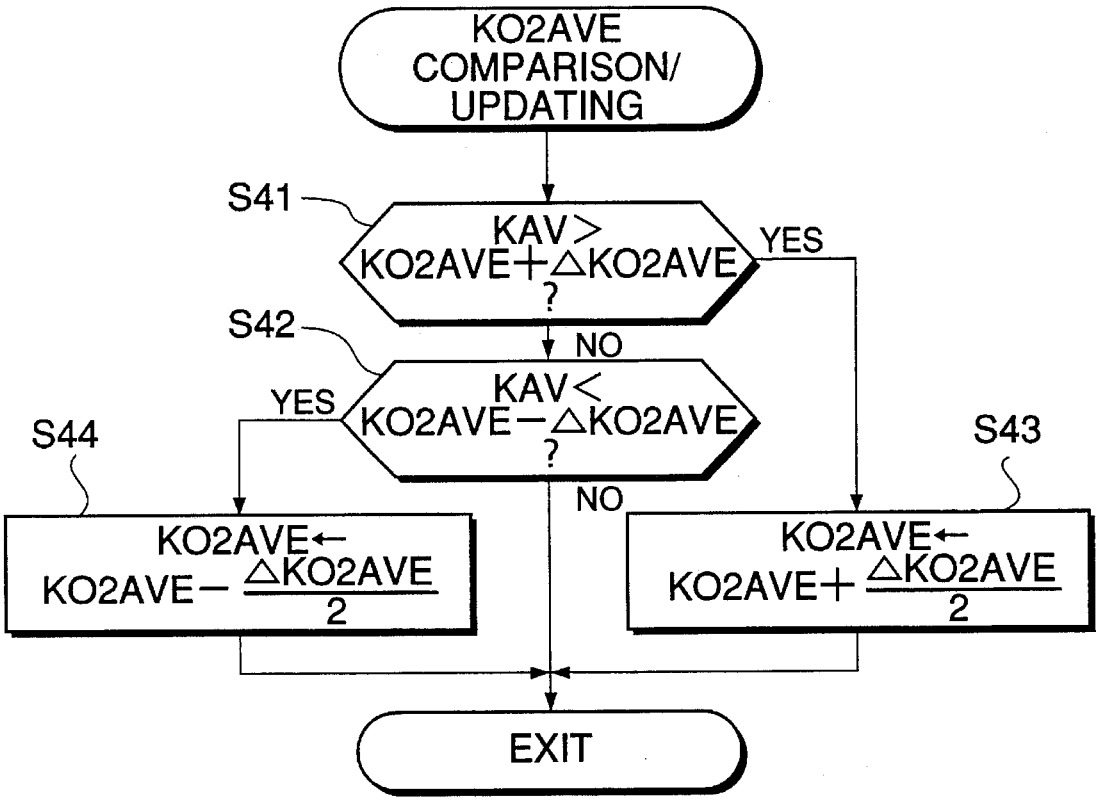
FIG. 5 is a flowchart showing a comparison/updating routine for executing comparison/updating of the abnormality-determining parameter KO2AVE.
Figure 6A:
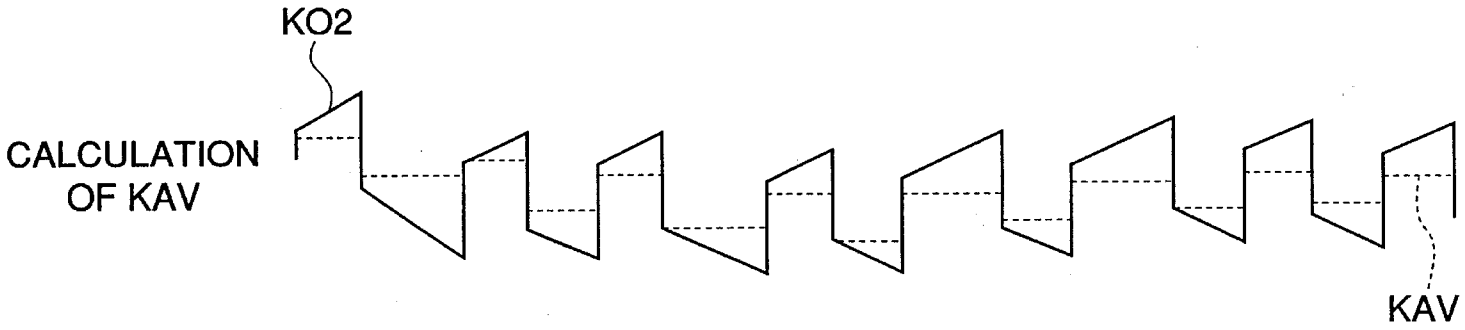
FIG. 6A and FIG. 6B are timing charts respectively showing changes in an integral value KAV and the abnormality-determining parameter KO2AVE.
Figure 6B:
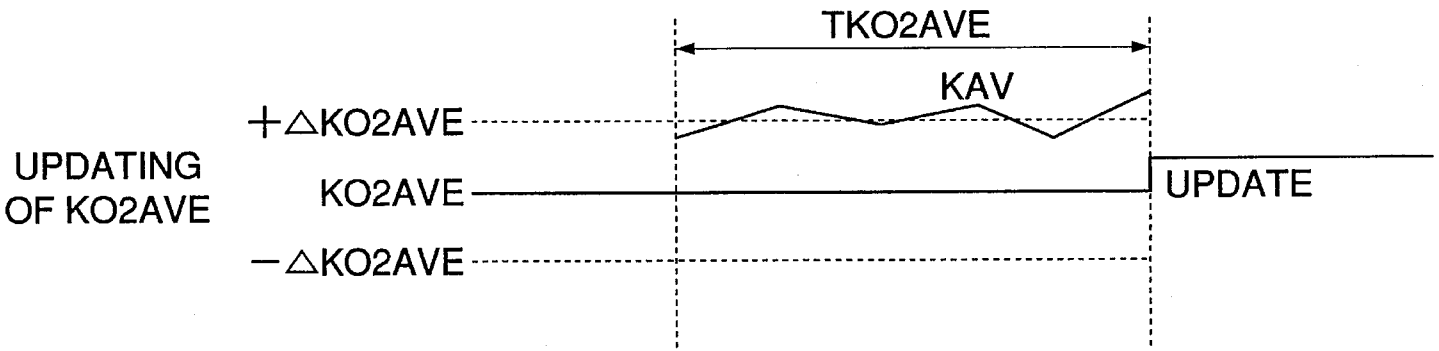

On the other hand, when the monitoring execution flag f3 assumes the value of 1, an average value of the air-fuel ratio correction coefficient K02 is calculated as an abnormality-determining parameter KO2AVE at a step S102. Now, a manner of calculation of the abnormality-determining parameter KO2AVE will be described first. FIG. 5 shows a routine for executing comparison/updating of the abnormality-determining parameter KO2AVE. In calculating the abnormality-determining parameter KO2AVE, an integral value (average value) KAV of the air-fuel ratio correction coefficient K02 is used. FIGS. 6A and 6B illustrate timing of updating of the integral valve KAV and the abnormality-determining parameter KO2AVE, respectively. The integral value KAV is updated whenever the proportional term control of the air-fuel ratio correction coefficient KO2 is executed, thereby undergoing changes e.g. as indicated by the broken lines in FIG. 6A.

In the FIG. 5 routine, which starts to be executed after a predetermined time period TKO2AVE as shown in FIG. 6B has elapsed, it is first determined at a step S41 whether or not the integral value KAV is higher than the sum of the present value of the abnormality-determining parameter KO2AVE and an aging-determining difference ΔKO2AVE (e.g. 0.0078), and if a condition of KAV>KO2AVE+ΔKO2AVE is fulfilled, the program proceeds to a step S43, wherein the abnormality-determining parameter KO2AVE is updated by the use of the following equation:

$$KO2AVE=KO2AVE+\Delta KO2AVE/2 \quad (2)$$

On the other hand, if a condition of KAV≦KO2AVE +ΔKO2AVE is fulfilled at the step S41, the program proceeds to a step S42, wherein it is determined whether or not the integral value KAV is lower than the difference between the present value of the abnormality-determining parameter KO2AVE and the aging-determining difference ΔKO2AVE. If a condition of KAV≧KO2AVE−ΔKO2AVE is fulfilled at the step S42, the routine is immediately terminated, while a condition of KAV<KO2AVE−ΔKO2AVE is fulfilled, the program proceeds to a step S44, wherein the abnormality-determining parameter KO2AVE is updated by the use of the following equation:

$$KO2AVE=KO2AVE-\Delta KO2AVE/2 \quad (3)$$

According to the present routine, so long as the integral value KAV is within a range of KO2AVE±ΔKO2AVE, the present value of the abnormality-determining parameter KO2AVE calculated in the immediately preceding loop is maintained, and when the integral value KAV falls outside this range, the abnormality-determining parameter KO2AVE is updated by the equation (2) or (3). FIG. 6B shows a case where the integral value KAV exceeds the sum of the present value of the abnormality-determining parameter KO2AVE and the aging-determining difference ΔKO2AVE after the lapse of the predetermined time period TKO2AVE has elapsed, so that the abnormality-determining parameter KO2AVE is updated.

Referring again to FIG. 2, after executing the routine for comparison/updating of the abnormality-determining parameter KO2AVE at the step S102, the program proceeds to a step S104, wherein it is determined whether or not the abnormality-determining parameter KO2AVE is higher than a predetermined upper limit value LMTH (e.g. 1.25). If a condition of KO2AVE <LMTH is fulfilled, a purge cut flag f1 is set to a value of 0 at a step S120, and it is determined at a step S122 that the fuel supply system is faulty, followed by terminating the program. The purge cut flag fl is set to a value of 1 when the purge cut or inhibition of purging of evaporative fuel is demanded, and to the value of 0 when the demand for the purge cut is canceled.

On the other hand, if a condition of KO2AVE≦LMTH is fulfilled at the step S104, it is determined at a step S106 whether or not the abnormality-determining parameter KO2AVE is higher than a reference value JUDGEB (e.g. 0.84) to determine whether the abnormality-determining parameter KO2AVE is affected by purging of evaporative fuel. If a condition of KO2AVE≦JUDGEB is fulfilled, that is, if the parameter KO2AVE is affected by the purging, the purge cut flag f1 is set to the value of 1 at a step S114. Then, it is determined at a step S116 whether or not the abnormality-determining parameter KO2AVE is lower than a predetermined limit value LMTL (e.g. 0.80). If a condition of KO2AVE≧LMTL is fulfilled, purging of evaporative fuel is forced to terminate at a step S117, and it is determined at a step S118 that the fuel supply system is normal in the present loop, followed by terminating the program. A time point t1 in FIGS. 4A–4E show an example of timing of the forced termination of the purging of evaporative fuel.

Further, if a condition of KO2AVE<LMTL is fulfilled at the step S116, the purge cut flag is set to the value of 0 at a step S120, and then it is determined at a step S122 that the fuel supply system is faulty, followed by terminating the program.

On the other hand, if a condition of KO2AVE>JUDGEB is fulfilled at the step S106, it is further determined at a step S108 whether or not the purge cut flag f1 has been set to the value of 1. If the flag f1 has been set to the value of 1, it is judged that the abnormality-determining parameter KO2AVE assumed a value lower than the reference value JUDGEB due to purging of evaporative fuel. Then, a purge influence flag f2 is set to a value of 1 at a step S110, and the purge cut flag f1 is reset to the value of 0 at a step S112 to thereby cancel the demand for the purge cut. Then, it is determined at a step S118 that the fuel supply system is normal, followed by terminating the present program. The purge influence flag f2 is set to the value of 1 in synchronism with cancellation of the demand for the purge cut, and reset to the value of 0 when it is judged that the average value of the air-fuel ratio correction coefficient is no longer under the influence of purging of evaporative fuel, as will be referred to hereinafter. A time point t2 in FIGS. 4A–4E represent an example of timing of cancellation of the demand for the purge cut.

Further, if it is determined at the step S108 that the purge cut flag f1 has been reset to the value of 0, it is immediately determined at the step S118 that the fuel supply system is normal, followed by terminating the program.

Next, description will be made, with reference to FIG. 3, of the aforementioned determining routine for determining whether or not the conditions for executing the fault-detecting monitoring, i.e. part of the FIG. 2 routine from the steps S102 to S122, are fulfilled.

In the FIG. 3 routine, it is first determined at a step S200 whether or not the purge influence flag f2 has been set to the value of 1. If the answer to this question is affirmative (YES), i.e. if the purge influence flag f2 has been set to the value of 1 at the aforementioned step S110 of the FIG. 2 routine based on the judgment that the abnormality-determining parameter KO2AVE assumed a value lower than the reference value JUDGEB due to purging of evaporative fuel, it is determined at a step S206 whether or not the count of a timer T for measuring a predetermined time period T is equal to 0. If the count of the timer T is not equal to 0, it is judged that the average value of the correction coefficient K02 still remains under the influence of resumed purging of evaporative fuel, so that the monitoring execution flag f3 is set to the value of 0 at a step S222, thereby inhibiting the execution of the fault-detecting monitoring.

On the other hand, when the count of the timer T is equal to 0, it is further determined at a step S208 whether or not the abnormality-determining parameter KO2AVE is higher than a reference value JUDGEA (e.g. 0.95).

If a condition of KO2AVE≦JUDGEA is fulfilled at the step S208, it is judged that the average value remains under the influence of purging of evaporative fuel, so that the timer T is set at a step S212, and the monitoring execution flag f3 is set to the value of 0 at the step S222. The timer T is set to the predetermined time period T which is to be counted down to 0 from the time point t2 appearing in FIG. 4 to a time point t3 in the same at which the influence of purging of evaporative fuel is deemed to be negligible due to progress of purging.

On the other hand, if the condition of KO2AVE>JUDGEA is fulfilled at the step S208, it is judged that the purging has been executed to such an extent that it does not adversely influence the fault-detecting monitoring any longer, so that the purge influence flag f2 is set to the value of 0 at a step 210, and the monitoring execution flag f3 is set to the value of 1 at a step S204, thereby canceling inhibition of the fault-detecting monitoring, i.e. permitting execution of the same.

Further, if it is determined at the step S200 that the purge influence flag f2 has been set to the value of 0, the timer T is set at a step S202, and the monitoring execution flag f2 is set to the value of 1 at the step S204, followed by terminating the present routine.

As described above, according to the present embodiment of the invention, during execution of the fault-detecting monitoring, the purging of evaporative fuel is forcibly inhibited if the abnormality-determining parameter KO2AVE becomes lower than the reference value JUDGEB, and the fault-detecting monitoring is inhibited after it is determined that the value of the abnormality-determining parameter KO2AVE lower than the reference value JUDGEB has been caused by purging of evaporative fuel and that the fuel supply system is normal. However, after the predetermined time period T has elapsed thereafter and the abnormality-determining parameter KO2AVE has become higher than the reference value JUDGEA, it is judged that the purging of evaporative fuel does not affect the fault-detecting monitoring any longer, to thereby permit the fault-detecting monitoring to be resumed. Compared with the prior art in which the fault-detecting monitoring cannot be carried out during the present operation of the engine, i.e. until after the ignition key is turned on to again start the engine, the device according to the invention is capable of carrying out detection of abnormality of the fuel supply system by checking the fuel supply system for a fault during continued operation of the engine while preventing degradation of exhaust emission characteristics and driveability of the engine due to variation in the air-fuel ratio which would otherwise result from repeated execution and inhibition of purging of evaporative fuel.

What is claimed is:

1. In a device for detecting abnormality of a fuel supply system of an internal combustion engine having an intake passage, an exhaust passage, at least one exhaust gas component concentration sensor arranged in said exhaust passage for detecting concentration of a component of exhaust gases, air-fuel ratio correction coefficient-calculating means for calculating an air-fuel ratio correction coefficient for correcting an amount of fuel to be supplied to said engine in response to an output from said at least one exhaust gas component concentration sensor such that an air-fuel ratio of a mixture supplied to said engine becomes equal to a predetermined value, a fuel tank, and purge control means for controlling supply of evaporative fuel generated within said fuel tank to said intake passage, said device having abnormality-determining means which inhibits said supply of said evaporative fuel to said intake passage when said air-fuel ratio correction coefficient becomes smaller than a predetermined value, said abnormality-determining means thereafter determining that said fuel supply system is normal when said air-fuel ratio correction coefficient increases above said predetermined value as a result of said inhibition of said supply of said evaporative fuel, the improvement wherein said abnormality-determining means comprises:

evaporative fuel supply-resuming means for permitting said supply of said evaporative fuel to said intake passage to be resumed after said determination that said fuel supply system is normal has been made;

determination-inhibiting means for inhibiting determination of abnormality of said fuel supply system after said supply of said evaporative fuel is restarted until said engine enters a predetermined operating condition in which said air-fuel ratio correction coefficient has increased; and determination-resuming means for permitting said determination of abnormality of said fuel supply system to be resumed, based on said air-fuel ratio correction coefficient when said engine has entered said predetermined operating condition.

2. A device according to claim 1, wherein said predetermined operating condition of said engine is a condition in which a predetermined time period has elapsed after said determination that said fuel supply system is normal was made and at the same time said air-fuel ratio correction coefficient increases above a second predetermined value higher than said predetermined value.

3. A device according to claim 1, wherein said air-fuel ratio correction coefficient used in said determination of said abnormality of said engine is an average value of said air-fuel ratio correction coefficient.

4. A device according to claim 1, wherein said abnormality-determining means determines that said fuel supply system is abnormal without inhibiting said supply of said evaporative fuel to said intake passage, when said air-fuel ratio correction coefficient is lower than a predetermined limit value lower than said predetermined value.

* * * * *